US006237908B1

(12) United States Patent
Chang et al.

(10) Patent No.: US 6,237,908 B1
(45) Date of Patent: May 29, 2001

(54) ELECTRONIC BOOK VERIFICATION SYSTEM

(75) Inventors: Bobby Chang, Thousand Oaks; Thang Hoang, Valinda, both of CA (US); Ronald D. Peadro, Charleston, IL (US)

(73) Assignee: R. R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 09/260,840

(22) Filed: Mar. 2, 1999

(51) Int. Cl.[7] ..... B42B 2/00

(52) U.S. Cl. ..... 270/52.15; 270/52.14; 270/52.16; 270/52.18; 270/52.26; 270/52.29

(58) Field of Search ..... 270/52.18, 52.14, 270/52.15, 52.16, 52.26, 52.29, 58.02, 58.03, 58.04, 58.29; 271/259, 263, 110, 111

(56) References Cited

U.S. PATENT DOCUMENTS

| | | | | |
|---|---|---|---|---|
| Re. 29,105 | | 1/1977 | Miaskoff et al. | 11/3 |
| 3,216,719 | * | 11/1965 | Flora | 270/58.29 |
| 3,525,516 | | 8/1970 | Bushnell et al. | 270/58 |
| 3,953,017 | | 4/1976 | Wise | 270/54 |
| 3,972,521 | | 8/1976 | Reed | 270/58 |
| 4,141,492 | | 2/1979 | Michel et al. | 235/437 |
| 4,170,346 | | 10/1979 | Murray et al. | 270/54 |
| 4,395,031 | * | 7/1983 | Gruber et al. | 270/52.29 |
| 4,497,480 | | 2/1985 | Nothdurft | 270/58 |
| 4,498,663 | | 2/1985 | Wamsley et al. | 270/54 |
| 4,625,954 | * | 12/1986 | Pusey | 270/58.03 |
| 4,641,825 | | 2/1987 | Mowry et al. | 270/54 |
| 4,757,984 | | 7/1988 | Rowe et al. | 270/58 |
| 4,778,167 | | 10/1988 | Snow et al. | 270/53 |
| 4,799,661 | | 1/1989 | Nail | 270/54 |
| 4,867,432 | | 9/1989 | Matta | 271/9 |
| 4,932,645 | | 6/1990 | Schorey et al. | 270/56 |
| 4,936,562 | | 6/1990 | Rowe | 270/56 |
| 4,966,354 | | 10/1990 | Grunder | 270/56 |
| 5,011,123 | | 4/1991 | Vigano | 270/54 |
| 5,013,022 | | 5/1991 | Graushar | 270/56 |
| 5,171,005 | | 12/1992 | Manley et al. | 270/1.1 |
| 5,222,729 | | 6/1993 | Wallaschkowski | 271/262 |
| 5,280,895 | | 1/1994 | Meier | 270/58 |
| 5,337,885 | | 8/1994 | Mills et al. | 198/502.4 |
| 5,413,321 | | 5/1995 | Banks et al. | 270/58 |
| 5,458,323 | | 10/1995 | Magee et al. | 270/54 |
| 5,503,382 | * | 4/1996 | Hansen et al. | 271/263 |
| 5,511,769 | * | 4/1996 | Wamsley et al. | 270/58.03 |
| 5,595,379 | * | 1/1997 | Hoang | 270/52.59 |
| 5,622,268 | * | 4/1997 | Conner et al. | 270/52.26 |
| 5,645,387 | | 7/1997 | Scalet et al. | 412/1 |
| 5,876,029 | * | 3/1999 | Wright et al. | 270/58.29 |
| 6,095,740 | * | 3/2000 | Hollenstein et al. | 270/52.26 |

* cited by examiner

*Primary Examiner*—H. Grant Skaggs
(74) *Attorney, Agent, or Firm*—Marshall, O'Toole, Gerstein, Murray & Borun

(57) ABSTRACT

In order to be able to eliminate a mechanical caliper, a bindery line has a plurality of signature feeders or packer boxes each of which is operable to feed a signature therefrom. A collating conveyor passes by each of the signature feeders or packer boxes along a signature conveying path so as to be operable to receive signatures from the signature feeders or packer boxes in collated form for forming a book. A book finishing section is downstream of the signature feeders or packer boxes for forming the book from the signatures received in collated order after the collating conveyor has passed by each of the signature feeders or packer boxes in travel along the signature conveying path. With this arrangement, the invention utilizes detectors for detecting a missing signature, an incorrect signature, a double signature, a conveyor jam, a hanging book, and a long book.

22 Claims, 3 Drawing Sheets

ELECTRONIC BOOK VERIFICATION SYSTEM

FIELD OF THE INVENTION

The present invention generally relates to delivering signatures to a binding line to form books and, more particularly, to a system for electronically verifying the proper formation of such books.

BACKGROUND OF THE INVENTION

In recent years, many large circulation periodicals have appeared which require rapid handling of portions of the periodicals consisting of signatures which are gathered for stitching, trimmed, bundled for minimum shipping costs, and shipped. A typical operation utilizes a multitude of packer boxes, each of which receives signatures seriatim from a signature supply means, opens each signature, and drops the signatures successively to straddle a gathering chain that runs in front of the packer boxes and carries the complete collection of gathered signatures to the stitcher. Moreover, because of the need for highly efficient plant operations, there has been a constant effort to increase the speed at which machines operate which has required the development of new techniques for handling the signatures at all stages of the binding process.

In addition to high speed operation, many large circulation periodicals are now demanding a degree of flexibility that has been heretofore considered impossible. This is particularly true, for instance, where the periodical wishes to produce a number of different versions of books by feeding different combinations of signatures to form such books, but this must be done without significant reduction in the cyclic rate of operation that would otherwise decrease plant efficiency thereby increasing costs while possibly failing to accommodate the high volume presently produced by the U.S. printing industry which requires that the most efficient possible use be made of manpower, equipment and plant space. Further, in order to avoid any increase in costs that might otherwise be attributable to new equipment, the equipment to achieve the aforementioned objectives should be relatively inexpensive and compatible with normal bindery lines.

As an additional problem, it has been widely recognized in the printing industry that mechanical calipers require significant make-ready time that decreases the efficiency of plant operations. This is particularly true for selectively gathered or customized books where there may typically be a large number of versions of a book requiring a large number of settings for the conventional mechanical caliper. As the need for flexibility has increased, there has been a corresponding recognition of the desirability of eliminating the use of a mechanical caliper while maintaining high quality production on a binding line.

The present invention is directed to overcoming one or more of the foregoing problems and achieving one or more of the resulting objects.

SUMMARY OF THE INVENTION

Accordingly, the present invention is directed to a bindery line having a plurality of signature feeders, each of which is operable to feed a signature therefrom. A collating conveyor passes by each of the signature feeders along a signature conveying path so as to be operable to receive the signatures which are being fed from the signature feeders in collated order to thereby form a book. A book finishing section is located downstream of the signature feeders to complete the book comprised of the signatures received in collated order after the collating conveyor has passed by each of the signature feeders in its travel along the signature conveying path. With this arrangement, the present invention comprises means associated with each of the signature feeders, the collating conveyor, and the book finishing section to ensure the proper formation of a book.

More specifically, the present invention includes means associated with each of the signature feeders at a point upstream of the collating conveyor for ensuring that a signature has been fed from the signature feeder to the collating conveyor. It also includes means associated with the collating conveyor adjacent each of the signature feeders for ensuring that signatures fed by the signature feeders have been properly received on the collating conveyor. Still additionally, the present invention includes means associated with the book finishing section at a point downstream of the signature feeders for ensuring that signatures received in collated order will not form a hanging book or a long book.

In a preferred embodiment, the means associated with each of the signature feeders comprises a missing signature detector and/or an incorrect signature detector and/or a double book detector. It is also advantageous for the means associated with the collating conveyor to comprise a missing signature detector and/or a conveyor jam detector. Still additionally, and in accordance with the invention, the means associated with the book finishing section preferably comprises a hanging book detector and/or a long book detector.

In a highly preferred embodiment, the bindery line has a plurality of packer boxes, each of which is selectively operable to feed a different signature therefrom, and the collating conveyor is then advantageously a continuous conveyor. The continuous conveyor is operable to receive different signatures which are selectively fed from the packer boxes to form a selectively gathered or customized book. With this arrangement, the invention preferably includes means responsive to conditions determined by the means associated with each of the packer boxes, collating conveyor, and book finishing section which is operatively associated with the bindery line.

With the present invention, the collating conveyor can comprise a gathering chain on a saddle binding line. Alternatively, the collating conveyor can comprise a conveyor belt on a square back binding line.

Preferably, the means associated with the signature feeders or packer boxes comprises a missing signature detector mounted generally in proximity to each of the signature feeders or packer boxes to determine whether any signature has been fed from the signature feeder or packer box to the collating conveyor. It is also highly advantageous for the means associated with each of the signatures feeders or packer boxes to comprise an incorrect signature detector mounted generally in proximity to the signature feeder or packer box to determine whether a correct signature has been fed from the signature feeder or packer box to the collating conveyor. It is further highly advantageous to have a double signature detector mounted generally in proximity to each of the signature feeders or packer boxes to determine whether a "double" signature has been fed from the signature feeder or packer box to the collating conveyor. Additionally, it is highly advantageous for the means associated with the collating conveyor to comprise a missing signature detector mounted generally opposite each of the signature feeders or packer boxes to determine whether a signature fed from the signature feeder or packer box has been received by the collating conveyor.

Still further, the means associated with the collating conveyor preferably includes a conveyor jam detector mounted generally opposite each of the signature feeders or packer boxes to determine whether signatures fed from the signature feeders or packer boxes are properly positioned on the collating conveyor. It is further highly advantageous for the means associated with the book finishing section to comprise a hanging book detector mounted generally adjacent the book finishing section to determine whether signatures received in collated order have proper lateral positioning therebetween. Still additionally, the means associated with the book finishing section preferably includes a long book detector mounted generally adjacent the book finishing section to determine whether signatures received in collated order have proper longitudinal positioning therebetween.

As for the means responsive to conditions which is operatively associated with the bindery line, this may advantageously comprise a visible indicator, an audible alarm, and/or a downstream shutoff capability in communication with a suitable controller.

Other objects, advantages and features of the present invention will become apparent from a consideration of the following specification taken in conjunction with the accompanying drawings.

DETAILED DESCRIPTION OF THE PREFERRED EMBODIMENT

Figure 1:
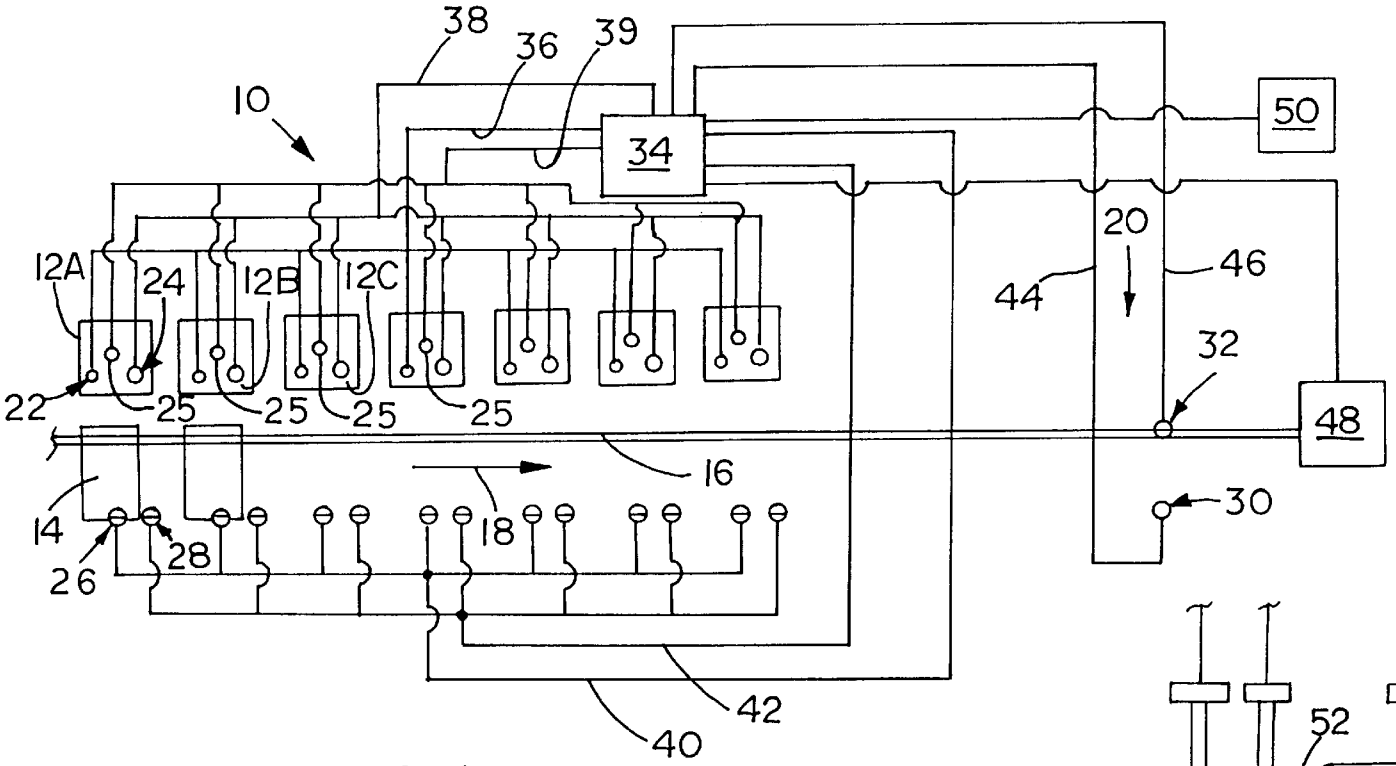
FIG. 1 is a schematic view of a bindery line utilizing an electronic book verification system in accordance with the present invention.

In the illustrations given, and with reference first to FIG. 1, the reference numeral 10 designates generally a bindery line in accordance with the present invention. The bindery line 10 includes a plurality of signature feeders or packer boxes 12*a,* 12*b,* 12*c,* etc. each of which is selectively operable to feed a different signature such as 14 therefrom. A continuous collating conveyor 16 passes by each of the packer boxes 12*a,* 12*b,* 12*c,* etc. generally along a signature conveying path represented by the arrow 18 so as to be operable to receive different signatures such as 14 in collated form wherein the signatures are selectively fed from the signature feeders or packer boxes 12*a,* 12*b,* 12*c,* etc. in order to form a book. The bindery line 10 also includes a book finishing section generally designated 20 downstream of the signature feeders or packer boxes 12*a,* 12*b,* 12*c,* etc. for forming the book from the different signatures such as 14 received in collated order on the collating conveyor 16. With this conventional bindery line arrangement, the invention includes a system of detectors at various points within the bindery line 10 to provide for electronic book verification.

Figure 2:
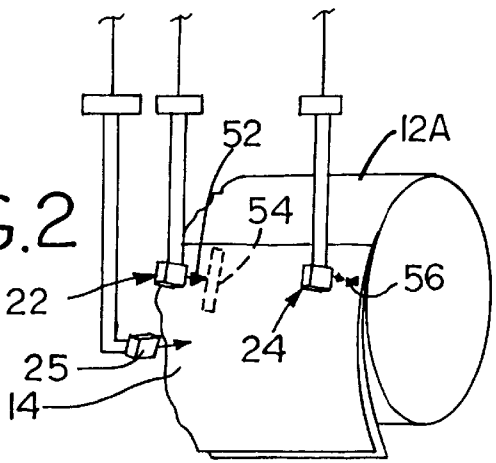
FIG. 2 is a perspective view illustrating a pair of sensors for each of the signature feeders of the bindery line of FIG. 1.

More specifically, and referring to FIGS. 1 and 2, the bindery line 10 suitably includes means associated with the signature feeders or packer boxes such as 12*a* in the form of a missing signature detector such as 22 mounted generally in proximity to the signature feeders or packer boxes such as 12*a* to determine whether any signature such as 14 is being fed from the signature feeder or packer box such as 12*a* to the collating conveyor 16. Also, the bindery line 10 includes means associated with the signature feeders or packer boxes such as 12*a* in the form of an incorrect signature detector such as 24 mounted generally in proximity to each of the signature feeders or packer boxes such as 12*a* to determine whether a correct signature such as 14 is being fed from the signature feeder or packer box such as 12*a* to the collating conveyor 16. Further, the bindery line 10 includes means associated with the signature feeders or packer boxes such as 12*a* in the form of a double signature detector such as 25 mounted generally in proximity to each of the signature feeders or packer boxes such as 12*a* to determine whether two signatures, i.e., a "double signature, is being fed from the feeder or packer box such as 12*a* to the collating conveyor.

Figure 4:
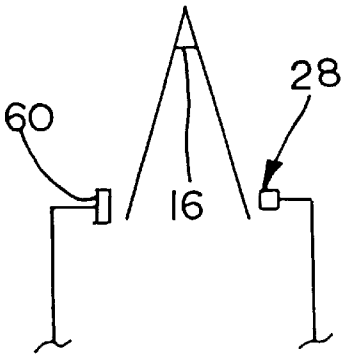
FIG. 4 is a cross-sectional view taken generally along the line 4—4 of FIG. 3.
Figure 3:
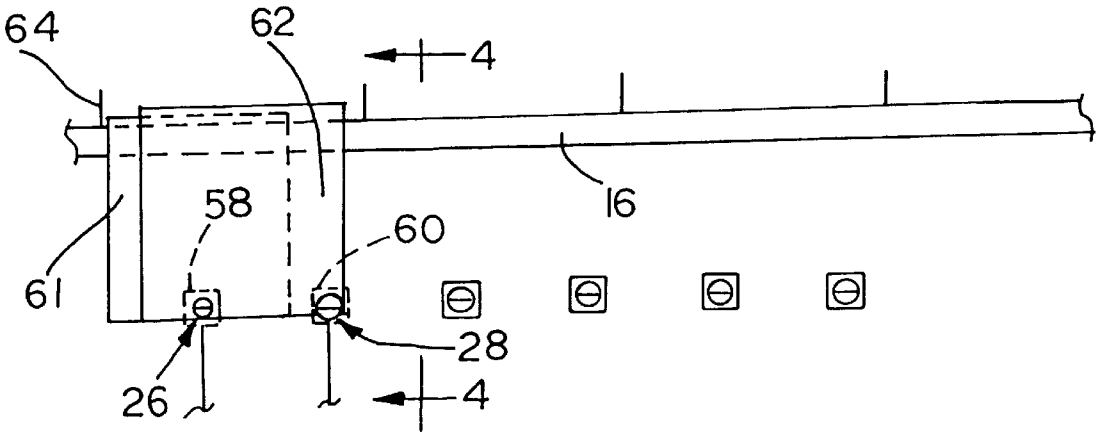
FIG. 3 is an elevational schematic view of another pair of sensors for a collating conveyor of the bindery line of FIG. 1.

Referring now to FIGS. 1, 3 and 4, the bindery line 10 includes means associated with the collating conveyor 16 in the form of a missing signature detector 26 mounted generally opposite each of the signature feeders or packer boxes such as 12*a* to determine whether a signature such as 14 fed from the signature feeder or packer box such as 12*a* has been received by the collating conveyor 16. As will be appreciated from FIG. 3, the bindery line 10 also includes means associated with the collating conveyor 16 in the form of a conveyor jam detector 28 mounted generally opposite each of the signature feeders or packer boxes such as 12*a* to determine whether signatures such as 14 fed from the signature feeders or packer boxes such as 12*a* are properly positioned on the collating conveyor 16.

Figure 6:
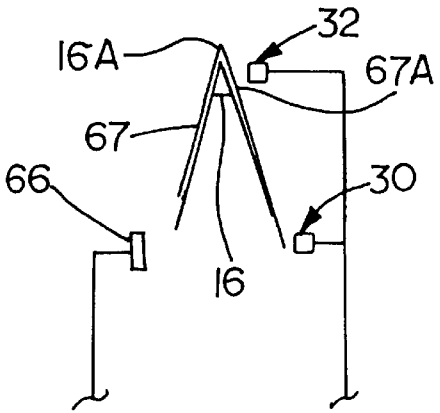
FIG. 6 is a cross-sectional view taken generally along the line 6—6 of FIG. 5.
Figure 5:
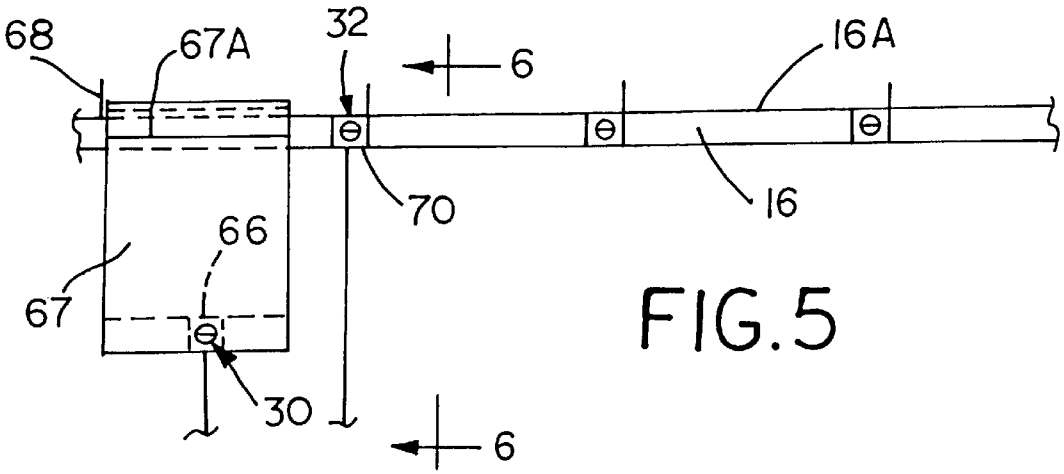
FIG. 5 is an elevational schematic view of yet another pair of sensors for a collating conveyor of the bindery line of FIG. 1.

Referring now to FIGS. 1, 5 and 6, the bindery line 10 includes means associated with the book finishing section 20 in the form of a hanging book detector 30 mounted generally adjacent the book finishing section 20 to determine whether signatures such as 14 received in collated order have proper lateral, i.e., vertical positioning therebetween. As will be appreciated from FIG. 5, the bindery line 10 also includes means associated with the book finishing section 20 in the form of a long book detector 32 mounted generally adjacent the book finishing section 20 to determine whether signatures such as 14 received in collated order had proper longitudinal, i.e., horizontal positioning therebetween.

Figure 7:
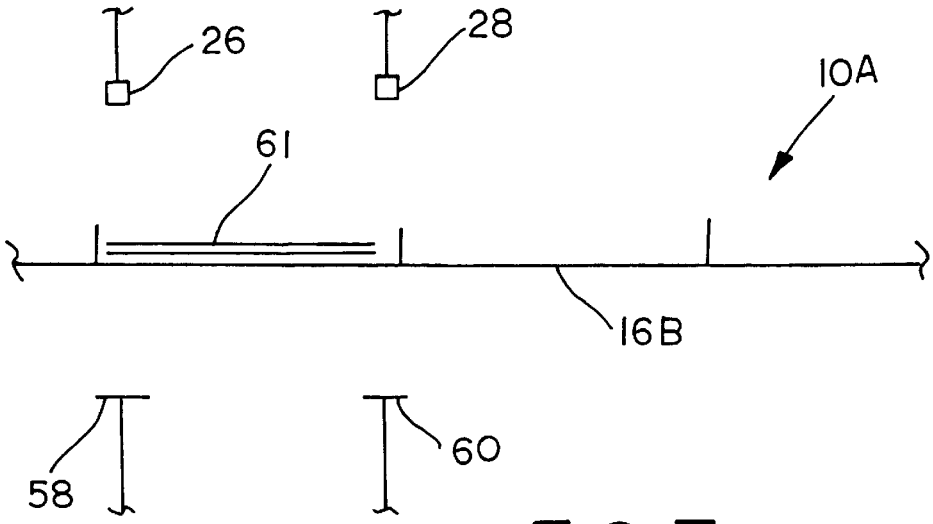
FIG. 7 is an elevational schematic similar to FIG. 3 but illustrating the pair of sensors adjacent the conveyor belt of a square back binding line.
Figure 8:
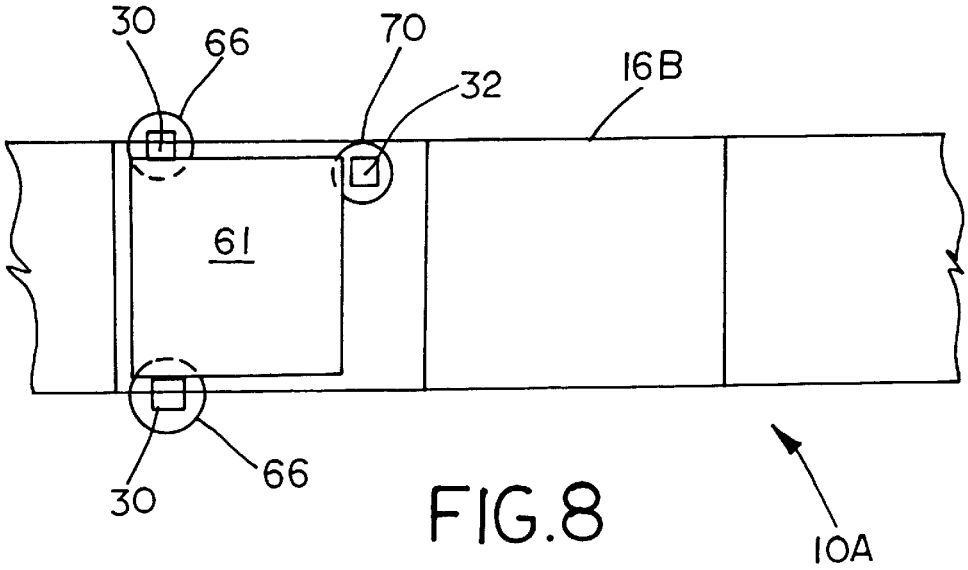
FIG. 8 is an elevational schematic similar to FIG. 5 but illustrating the another pair of sensors adjacent the conveyor belt of the square back binding line of FIG. 7.

With this general understanding of the invention, it will further be appreciated that the collating conveyor 16 can take the form of either a gathering chain (as shown in FIGS. 3 and 5) on a saddle binding line or a conveyor belt 16*b* on a square back binding line 10*a* as shown in FIGS. 7 and 8.

In the preferred embodiment of the invention, the bindery line 10 will suitably include a programmable line controller 34 that may be used to perform all of the conventional functions required to control the operation of a bindery line. Since most of these conventional functions are well known to those skilled in the art, they need not be described herein; instead, the controller 34 will be described solely in connection with its function which relate to the detectors 22, 24, 26, 28, 30, and 32.

Referring specifically to FIG. 1, the missing signature detectors such as 22 are all linked to the controller 34 by a suitable signal transmitting line such as 36. Similarly, the incorrect signature detectors such as 24 are all linked to the controller 34 by a suitable signal transmitting line such as 38. Likewise, the double signature detectors such as 25 are all linked to the controller by a suitable signal transmitting line such as 39.

In addition, the missing signature detectors such as 26 and conveyor jam detectors such as 28 are linked to the controller 34 by suitable signal transmitting lines such as 40 and 42, respectively. Furthermore, the hanging book detector 30 and long book detector 32 are each linked to the controller 34 by suitable signal transmitting lines such as 44 and 46, respectively.

With this arrangement, the controller 34 is advantageously of the programmable type. This makes it possible for the signals that are transmitted from the various detectors via the signal transmitting lines 36, 38, 40, 42, 44, and 46 to be used in various ways, e.g., to cause an improperly formed book to be rejected at a downstream location along the collating conveyor 16 as at 48, to signal a sense perceptive alarm as at 50, e.g., a visible indicator and/or an audible alarm, and/or to stop the operation of the bindery line 10. Clearly, this gives needed flexibility in terms of the operation of the bindery line 10.

As for specifics of the various detectors that have been described above, the missing signature detectors such as 22 may be of the type which transmits a light beam as at 52 toward a reflector such as 54 to sense a reflection of the light beam. It will be appreciated that the missing signature detector 22 will be triggered by the controller 34 to transmit the light beam such as 52 when a signature such as 14 should be between the missing signature detector 22 and the reflector 54, i.e., at a point in time when the controller 34 is aware that a signature such as 14 should be in the process of being fed from the signature feeder or packer box such as 12*a* to the collating conveyor 16. If a reflection of the light beam is sensed by the missing signature detector 22, a signature is sent via the signal transmitting line 36 to the controller 34 indicating that no signature was fed from the signature feeder or packer box such as 12*a* to the collating conveyor 16.

As shown in FIG. 2, the incorrect signature detectors such as 24 can be of a type that senses a code such as 56 which is provided on a marginal edge of a signature such as 14. This code can take a number of forms such as a bar code, a dot pattern, etc., with a different code being given for the signatures to be fed from each of the signature feeders or packer boxes such as 12*a*, 12*b*, 12*c*, etc. In this manner, the incorrect signature detectors such as 24 can send a signal via the signal transmitting line 38 in the event an incorrect signature is being fed from any of the signature feeders or packer boxes such as 12*a*, 12*b*, 12*c*, etc.

Alternatively, the incorrect signature detector could be a simple eye that detects a mark in a different specified location for each signature or a bar code reader ro read a bar code in the same location on all signatures as suggested above.

As also shown in FIG. 2, the double signature detectors such as 25 can be of the proximity switch and actuator type that senses the proximity of the signature(s) such as 14 to determine whether more than one signature has been simultaneously fed by the signature feeders or packer boxes such as 12*a*.

With regard to the missing signature detectors such as 26 and the conveyor jam detectors such as 28, they can be of a similar nature to the missing signature detector 22, i.e., as shown in FIGS. 1, 3 and 4, the detectors such as 26 and 28 may be positioned to transmit light beams toward reflectors such as 58 and 60. Further, the detectors 26 and 28 and reflectors 58 and 60 are suitably positioned on opposite sides of the collating conveyor 16 such that a signature such as 61 blocks the light beam transmitted by the missing signature detector 26 toward the reflector 58 when the signature is, in fact, present and a signature such as 62 only blocks the light beam transmitted by the conveyor jam detector 28 toward the reflector 60 when there is a jam of signatures on the collating conveyor 16 causing this to occur. Thus, the missing signature detector 26 sends a signal via the signal transmitting line 40 to the controller 34 when the light beam is reflected from the reflector 58 (i.e., when there is a missing signature) and the conveyor jam detector 28 sends a signal via the signal transmitting line 42 to the controller 34 when the light beam is not reflected from the reflector 60 (i.e., when there is a jam of signatures on the collating conveyor 16).

As will be appreciated, the missing signature detector 26 will preferably be positioned so that the light beam transmitted by it will be blocked when a signature such as 61 has been properly placed on the collating conveyor 16. The controller 34 will control the timing of transmitting the light beam from the missing signature detector 26 such that a signature such as 14 will be in place and will block the light beam so that it will not be reflected by the reflector 58 if the signature has been properly received by the collating conveyor 16. Similarly, the conveyor jam detector 28 will preferably be positioned so that the light beam transmitted by it will be blocked when there has been a jam of signatures on the collating conveyor 16. The controller 34 will control the timing of transmitting the light beam from the conveyor jam detector 28 such that the jam will be detected by reason of the location of the conveyor jam detector 28 in relation to the chain pin 64. Specifically, if there is no jam the light beam transmitted by the conveyor jam detector 28 will be reflected by the reflector 60 due to the position of the conveyor jam detector in relation to the chain pin 64 at the point in time when the controller directs the conveyor jam detector to transmit the light beam.

With regard to the hanging book detector 30 and the long book detector 32, they operate in a manner similar to the missing signature detector 26 and the conveyor jam detector 28, but downstream therefrom. Thus, the hanging book detector 30 transmits a light beam toward a reflector 66 on the opposite side of the collating conveyor 16. It is suitably positioned such that the light beam will normally be reflected from the reflector 66 except for instances in which there is a "hanging" book, i.e., one in which the backbone 67*a* of one of the signatures such as 67 is positioned to one side or the other of the apex 16*a* of the collating conveyor or chain 16. If this occurs, the light beam from the hanging book detector 30 is blocked by the hanging book, and is therefore not reflected. With this arrangement, the controller 34 times the transmission of the light beam from the hanging book detector 30 to occur at an appropriate time to discover a hanging book.

More specifically, if there is a hanging book, the light beam that is transmitted by the hanging book detector is prevented from being reflected by the reflector 66. This is due to the fact that the light beam is blocked from being transmitted to and reflected by the reflector 66 by reason of the position of the signature 67 wherein the light beam is transmitted at a time when the position of the hanging book detector 30 in relation to the chain pin 68 is such that any such improperly positioned signature will cause this blockage of the light beam. If the light beam is not reflected, the hanging book detector 30 transmits a signal representing this condition via the signal transmitting line 44 to the controller 34.

In like fashion, the long book detector 32 transmits a light beam toward a reflector 70 that may suitably be provided on the same side of the collating conveyor 16. It is suitably positioned such that the light beam will normally be reflected from the reflector 70. This will occur except for instances in which there is a "long" book, i.e., one in which the backbones of the signatures of a book are not in longitudinal alignment aligned by reason of engagement with the chain pin 68. The light beam from the long book detector 32 will then be blocked by the long book, and therefore not reflected. With this arrangement, the controller 34 times the transmission of the light beam from the long book detector 32 to occur at an appropriate time to discover a long book.

In the preferred embodiment, there will be a succession of reflectors such as 70 disposed along the collating conveyor 16 at fixed distances from the corresponding one of the chain pins such as 68 and, if there is a long book, the light beam that is transmitted by the long book detector 32 is prevented from being reflected by the reflector 70 due to the position of the long book detector in relation to the chain pin 68 and the long book detector 32 transmits a signal via the signal transmitting line 46 to the controller 34.

As for the various sensors 22, 24, 25, 26, 28, 30, and 32, they may take the form of any of a number of commercially available sensors that are known to those skilled in the art. It will also be appreciated that the signals sent to the controller 34 by the various sensors, i.e., that there is a missing signature in the packer box (from the missing signature detector 22), that there is an incorrect signature in the packer box (from the incorrect signature detector 24), that there is more than one signature being simultaneously fed by the packer box (from the double signature detector 12*a*), that there is a missing signature on the collating conveyor (from the missing signature detector 26), that there is a signature jam on the collating conveyor (from the conveyor jam detector 28), that there is a hanging book on the collating conveyor (from the hanging book detector 30), and/or that there is a long book on the collating conveyor (from the long book detector 32), can be processed and used in a variety of ways. In particular, the controller 34 can use any one or more of these signals to cause an improper book to be rejected, activate a visual indicator, activate an audible alarm, and/or cause the operation of the bindery line to stop.

With the foregoing understanding, it will be appreciated that there is no longer any need for using mechanical calipers. This is particularly advantageous for selectively gathered or customized books where there may be a large number of versions requiring a large number of settings for the conventional mechanical caliper. By reason of the use of the various detectors, which are all coupled to the controller, it is now possible to eliminate the mechanical caliper.

As will now be appreciated, by use of the various detectors, the electronic book verification system is able to check different possibilities and activate responsive measures including visual indicators, audible alarms and/or bindery line shut down, wherein the different possibilities checked include at least:

1) Packer box missing signature detection at time of feed;
2) Packer box missing signature detection at conveyor;
3) Unidentified signature detection on conveyor at packer box;
4) Jam detection on conveyor at location of packer box;
5) Signature verification for signatures fed from packer boxes;
6) Long book detection after all signatures are gathered; and
7) Hanging book detection after all signatures are gathered.

While in the foregoing there has been set forth a preferred embodiment of the invention, it will be appreciated that the details herein given may be varied by those skilled in the art without departing from the true spirit and scope of the appended claims.

What is claimed is:

1. In a bindery line having a plurality of signature feeders each of which is operable to feed a signature therefrom, a collating conveyor passing by each of said signature feeders along a signature conveying path so as to be operable to receive signatures fed from said signature feeders in collated order for forming a book, and a book finishing section downstream of said signature feeders for forming said book from said signatures received in collated order, the improvement comprising:

means associated with each of said signature feeders at a point upstream of said collating conveyor for ensuring that a signature has been fed from said signature feeder to said collating conveyor;

means associated with said collating conveyor adjacent each of said signature feeders for ensuring that signatures fed by said signature feeders have been properly received on said collating conveyor; and means associated with said book finishing section at a point downstream of said signature feeders for ensuring that signatures received in collated order will not form a hanging book or a long book.

2. The bindery line of claim 1 wherein said means associated with said signature feeders comprises a missing signature detector.

3. The bindery line of claim 1 wherein said means associated with said signature feeders comprises an incorrect signature detector.

4. The bindery line of claim 1 wherein said means associated with said signature feeders comprises a double signature detector.

5. The bindery line of claim 1 wherein said means associated with said collating conveyor comprises a missing signature detector.

6. The bindery line of claim 1 wherein said means associated with said collating conveyor comprises a conveyor jam detector.

7. The bindery line of claim 1 wherein said means associated with said book finishing section comprises a hanging book detector.

8. The bindery line of claim 1 wherein said means associated with said book finishing section comprises a long book detector.

9. In a bindery line having a plurality of packer boxes each of which is selectively operable to feed a different signature therefrom, a continuous collating conveyor passing by each of said packer boxes generally along a signature conveying path so as to be operable to receive different signatures in collated form which are selectively fed from said packer boxes in order to form a book, and a book finishing section downstream of said packer boxes for forming said book from said different signatures received in collated order on said collating conveyor, the improvement comprising:

means associated with each of said packer boxes at a point upstream of said collating conveyor for ensuring that a signature has been fed from said packer boxes to said collating conveyor;

means associated with said collating conveyor generally adjacent each of said packer boxes for ensuring that signatures fed by said packer boxes have been properly received on said collating conveyor;

means associated with said book finishing section at a point downstream of said packer boxes for ensuring that signatures received in collated order will not form a hanging book or a long book; and means responsive to conditions determined by said means associated with each of said packer boxes, said collating conveyor, and said book finishing section operatively associated with said bindery line.

10. The bindery line of claim 9 wherein said collating conveyor is a gathering chain on a saddle binding line.

11. The bindery line of claim 9 wherein said collating conveyor is a conveyor belt on a square back binding line.

12. The bindery line of claim 9 wherein said means associated with said packer boxes comprises a missing signature detector mounted generally in proximity to each of said packer boxes to determine whether any signature has been fed from said packer box to said collating conveyor.

13. The bindery line of claim 9 wherein said means associated with said packer boxes comprises an incorrect signature detector mounted generally in proximity to each of said packer boxes to determine whether a correct signature has been fed from said packer box to said collating conveyor.

14. The bindery line of claim 9 wherein said means associated with said packer boxes comprises a double signature detector mounted generally in proximity to each of said packer boxes to determine whether more than one signature has been fed from said packer box to said collating conveyor.

15. The bindery line of claim 9 wherein said means associated with said collating conveyor comprises a missing signature detector mounted generally opposite each of said packer boxes to determine whether a signature fed from said packer box has been received by said collating conveyor.

16. The bindery line of claim 9 wherein said means associated with said collating conveyor comprises a conveyor jam detector mounted generally opposite each of said packer boxes to determine whether signatures fed from said packer boxes are properly positioned on said collating conveyor.

17. The bindery line of claim 9 wherein said means associated with said book finishing section comprises a hanging book detector mounted generally adjacent said book finishing section to determine whether signatures received in collated order have proper lateral positioning therebetween.

18. The bindery line of claim 9 wherein said means associated with said book finishing section comprises a long book detector mounted generally adjacent said book finishing section to determine whether signatures received in collated order have proper longitudinal positioning therebetween.

19. A bindery line comprising:

a collating conveyor, the collating conveyor adapted to receive a first signature and a second signature in a desired collated order to form a book and to route the first and second signatures along a signature conveying path to a book finishing station;

first and second signature feeders mounted adjacent to the collating conveyor, the first signature feeder arranged to deliver the first signature to the collating conveyor and the second signature feeder arranged to deliver the second signature to the collating conveyor, the first and second signature feeders operable to feed the first and second signatures therefrom to the collating conveyor such that the signatures received thereon will be in the desired collated order;

a feeder detector associated with each of the first and second signature feeders, each feeder detector disposed upstream of the collating conveyor, each feeder detector arranged to detect at least one of a missing signature condition, a double signature condition, and an incorrect signature condition;

a conveyor detector associated with each of the first and second signature feeders, each conveyor detector disposed adjacent the collating conveyor, each conveyor detector arranged to detect at least one of a jam condition and a missing signature condition; and a finishing detector associated with the finishing station, the finishing detector arranged to detect in the book at least one of a hanging book condition and a long book condition.

20. The bindery line of claim 19, including a controller operatively connected to each of the feeder detector, the conveyor detector, and the finishing detector, the controller arranged to generate an error signal in response to the detection of any one of the conditions by the feeder detector, the conveyor detector, or the finishing detector.

21. A bindery line comprising:

a conveyor, the conveyor adapted to receive a first signature and a second signature in a desired order to form a book and to route the first and second signatures along a signature conveying path to a book finishing station;

first and second signature feeders mounted adjacent to the conveyor, the first signature feeder arranged to deliver the first signature to the conveyor and the second signature feeder arranged to deliver the second signature to the conveyor, the first and second signature feeders operable to feed the first and second signatures therefrom to the conveyor such that the signatures received thereon will be in the desired order;

a first detector associated with each of the first and second signature feeders, each first detector disposed upstream of the conveyor, each first detector arranged to detect at least one of a missing signature condition, a double signature condition, and an incorrect signature condition;

a second detector associated with each of the first and second signature feeders, each second detector disposed adjacent the conveyor, each second detector arranged to detect at least one of a jam condition and a missing signature condition; and a third detector associated with the finishing station, the third detector arranged to detect in the book at least one of a first positioning error indicative of a signature misalignment in a first direction and a second positioning error indicative of a signature misalignment in a second direction.

22. The bindery line of claim 21, including a controller operatively connected to each of the first detectors, the second detectors, and the third detectors, the controller arranged to generate an error signal in response to the detection of any one of the conditions by the first detector, the second detector, or the third detector.

* * * * *